US008157353B2

(12) United States Patent
Fukui et al.

(10) Patent No.: US 8,157,353 B2
(45) Date of Patent: Apr. 17, 2012

(54) LIQUID EJECTION RECORDING HEAD

(75) Inventors: Shigeki Fukui, Kawasaki (JP); Ken Ikegame, Atsugi (JP); Shuichi Murakami, Kawasaki (JP); Yasushi Iijima, Tokyo (JP); Yasunori Takei, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 614 days.

(21) Appl. No.: 12/354,417

(22) Filed: Jan. 15, 2009

(65) Prior Publication Data

US 2009/0185001 A1 Jul. 23, 2009

(30) Foreign Application Priority Data

Jan. 23, 2008 (JP) ..... 2008-012886

(51) Int. Cl.
*B41J 2/14* (2006.01)

(52) U.S. Cl. ..... 347/47

(58) Field of Classification Search ..... 347/22, 347/33, 47

See application file for complete search history.

(56) References Cited

U.S. PATENT DOCUMENTS 5,748,214 A * 5/1998 Usui et al. ..... 347/70
6,431,682 B1 8/2002 Osada et al.
6,447,984 B1 9/2002 Tatsumi et al.
6,527,377 B1 3/2003 Ikegame et al.
6,799,831 B2 * 10/2004 Inamoto et al. ..... 347/44
2003/0048328 A1 3/2003 Inamoto et al.
2009/0015639 A1 1/2009 Fukui et al.
2009/0185000 A1 7/2009 Ikegame et al.

FOREIGN PATENT DOCUMENTS

JP 10-157150 6/1998
JP 11-138817 5/1999
JP 2003-80717 3/2003

* cited by examiner

*Primary Examiner* — Geoffrey Mruk

(74) *Attorney, Agent, or Firm* — Fitzpatrick, Cella, Harper & Scinto

(57) ABSTRACT

A liquid ejection recording head includes a recording element substrate including a plurality of energy generating elements for generating energy for ejecting liquid, and a flow passage-forming member, connected to the recording element substrate, comprising a plurality of ejection outlets corresponding to the plurality of energy generating elements and plurality of flow passages communicating with the ejection outlets. The flow passage-forming member includes a hole array having holes arranged so as to surround the flow passages and a communication passage, for establishing communication between adjacent holes, at a position close to the recording element substrate.

6 Claims, 9 Drawing Sheets

Fig. 6A
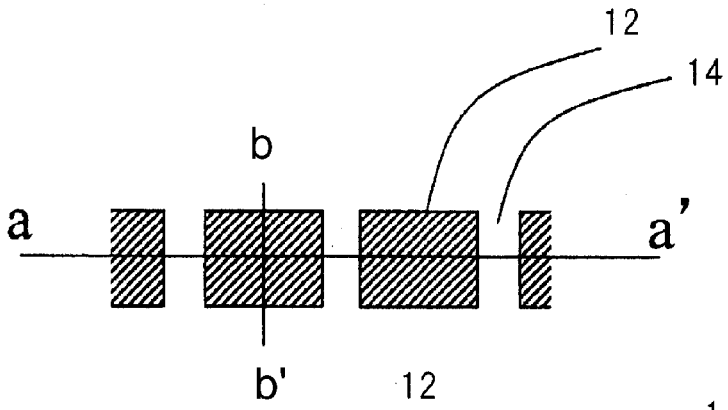
Fig. 6B
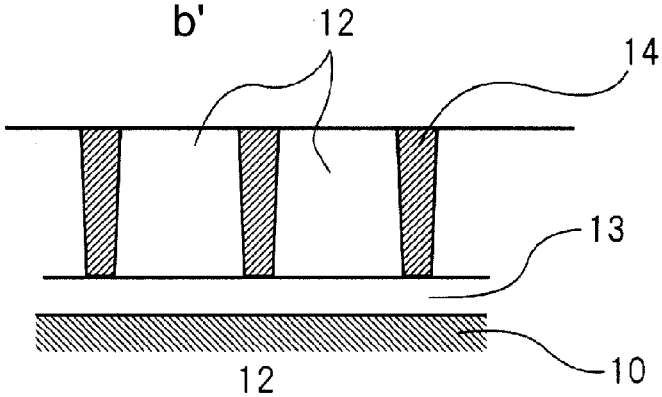
Fig. 6C
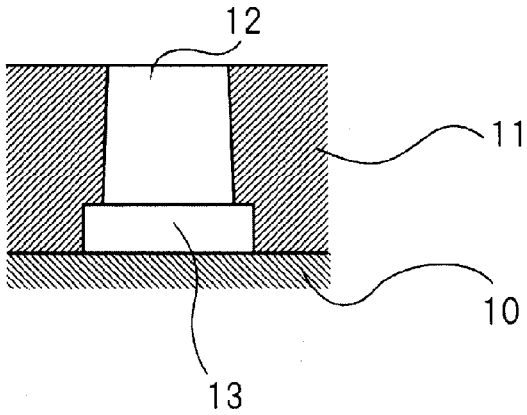
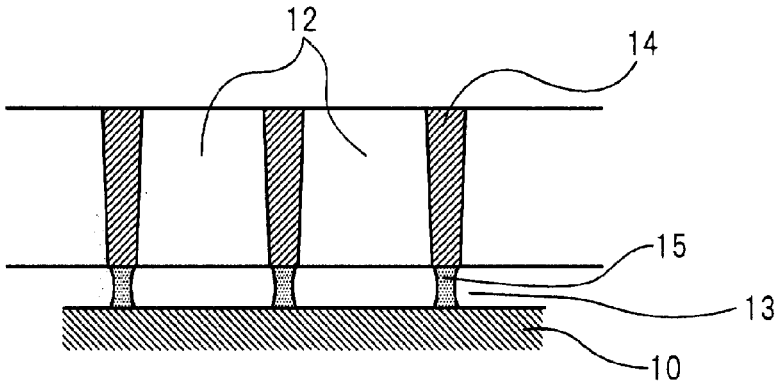
Fig. 7

LIQUID EJECTION RECORDING HEAD

FIELD OF THE INVENTION AND RELATED ART

The present invention relates to a liquid ejection recording head for ejecting liquid to form ejection droplets, thereby to effect recording.

The liquid ejection recording head has a constitution such that a flow passage-forming member (hereinafter referred to as an "orifice plate") including a plurality of ink ejection outlets and grooves as ink flow passages communicating with the ink ejection outlets is connected onto a recording element substrate. The recording element substrate is provided with an ink supply port which is opened. At a surface of the recording element substrate connected with the orifice plate, a plurality of energy generating elements (heat generating resistors) is disposed at positions corresponding to those of the ink ejection outlets. By the connection between the recording element substrate and the orifice plate, the ink flow passages are formed so as to establish communication from the ink supply port to the ink ejection outlets located above the heat generating resistors. Therefore, ink is supplied from the ink supply port to the ink flow passages and is ejected from the ink ejection outlets by pressure of bubbles generated by the action of the heat generating resistors.

Such a liquid ejection recording head is manufactured by forming a dissoluble resin layer on the recording element substrate provided with the energy generating elements (heat generating resistors) for ink ejection and then forming thereon a coating resin layer constituting the orifice plate by application (coating) through spin coating or the like. Then, on the coating resin layer, the ink ejection outlets are formed. Thereafter, the dissoluble resin layer is dissolved and at the same time the ink ejection outlets are formed. As a result, the dissolved portion of the resin layer constitutes the ink flow passages communicating with the ink ejection outlets and the ink supply port, so that the heat generating resistors are present correspondingly to the ink flow passages.

However, in this method, the coating resin layer is formed along a corner portion (stepped portion) of the dissoluble resin layer, so that variation between a thicker portion and a thinner portion of the orifice plate can occur. In the case of the liquid ejection recording head having such a non-uniform thickness structure of the orifice plate, there is a possibility that the thinner portion of the orifice plate is separated or broken by being subjected to stress concentration. An ejection amount of the ink is determined by a gap between the heat generating resistor for generating ink ejection energy and a front surface of the orifice plate. Therefore, when the thickness of the orifice plate is not constant and thus the gap between the orifice plate and the heat generating resistor is non-uniform, it is very difficult to stably effect small droplet recording as one of effective means for realizing high-definition recording.

A method for solving such a problem is, e.g., disclosed in Japanese Laid-Open Patent Application (JP-A) Hei 10-157150 and JP-A Hei 11-138817. In manufacturing methods described in JP-A Hei 10-157150 and JP-A Hei 11-138817, for the purpose of forming the orifice plate in a flat shape, the dissoluble resin layer is formed on not only a pattern constituting the ink flow passages but also an outer peripheral portion of the pattern, so that the coating resin layer is formed by using the dissoluble resin layer as a base. According to such a method that grooves are formed at the outer peripheral portion of the ink flow passages, the coating resin layer can be formed in the flat shape, so that the thickness of the orifice plate is uniform. Therefore, the resultant liquid ejection recording head is uniform in gap between the front surface of the orifice plate and the heat generating resistor, so that it is possible to stably effect the small droplet recording for realizing the high-definition recording.

Further, not only the neighborhood of the ink ejection outlets but also an outside of the ink ejection outlets are covered with the orifice plate, so that the surface of the substrate is not exposed over a large area. As a result, when the liquid ejection recording head is implemented or mounted in a printer for use, it is possible to prevent the surface of the recording element substrate from being damaged to cause ejection defect.

Even in such a liquid ejection recording head, there was a possibility that an edge portion of the grooves formed at the periphery of the ink flow passages, i.e., an edge portion of the orifice plate, is separated with an elongated head due to a stress generated by curing of the orifice plate or a change in temperature of the orifice plate. Particularly, compared with an inside of the orifice plate decreased in volume due to provision of the ink ejection outlets and the ink flow passages, the orifice plate has a large volume at the outside of the grooves and therefore is subjected to large stress, so that a frequency of occurrence of separation is further increased. This separation is more liable to occur since the stress is larger with an increasing thickness of the orifice plate for the liquid ejection recording head.

JP-A 2003-080717 discloses flow passages formed by connecting a recording element substrate and an orifice plate. The orifice plate includes a hole portion array consisting of many hole portions 12 formed so as to surround an outside of a flow passage group for each other (FIG. 10) or includes sawtooth (-like) grooves. As a result, in the hole portions of the orifice plate or in the neighborhood of an edge portion of the grooves, there are stresses directed in various directions in mixture and parts of the stresses cancel each other, so that the stresses acting on the orifice plate in this range are smaller than conventional ones. Therefore, a degree of liability to separation is suppressed at a low level.

However, the above-described conventional liquid ejection recording heads have been accompanied with the following problems.

That is, in the case where the orifice plate is provided with the hole portion array having a shape, as shown in FIG. 10, such that many hole portions are formed so as to surround the outside of the flow passages, a problem described below occurred during manufacturing of the liquid ejection recording head. During the manufacturing of the liquid ejection recording head, printing is actually carried out in order to inspect a print performance of the liquid ejection recording head. After the inspection of the print performance, mist-like ink droplets deposited on the head surface are washed and then are dried. This drying is normally performed by air blow. However, in the case of the shape having the hole portion array as shown in FIG. 10, the hole portions 12 are communication passages which are opened at only one surface, so that an air blow effect cannot be obtained sufficiently. As a result, water droplets or ink droplets which had not been completely dried were left in the hole portions in some cases. FIG. 11 is an enlarged view of a portion C shown in FIG. 10. As shown in FIG. 11, water droplets or ink droplets 16 which have not been completely dried are liable to remain at a side surface portion of the hole portions 12. Incidentally, in FIG. 11, the orifice plate on the recording element substrate is illustrated as a transparent member.

In the case where the liquid ejection recording head is packed in this state and is subjected to a temperature change during transport until the liquid ejection recording head is delivered to a user, the water droplets remaining in the hole portions or the ink droplets which have not been completely dried and have remained in the hole portions are vaporized, so that a viscosity-increased matter or a fixing matter has remained in the hole portions. Thereafter, during printing by the user, the viscosity increased matter or fixing matter of the ink can be drawn out to the head surface by a cleaning wiping operation or the like of the head surface for the purpose of refreshing an ejection function in a printer. Then, these matters come near to the neighborhood of the ink ejection outlets, so that a lowering in image quality such as stripes or non-uniformity occurred in some cases.

As another problem, in the case of a shape having grooves formed so as to surround the ink flow passages, when the head was further increased in length, there was a possibility that a stress applied to four corners of the substrate, a stress applied to a nozzle wall end, and a stress applied between the substrate and the flow passage-forming member at an edge portion of the grooves formed at a periphery of the ink flow passages were increased. Due to the stress increases, such a phenomenon that the flow passage-forming member was separated from the recording element substrate occurred, so that it was difficult to elongate the liquid ejection recording head.

Further, when the above-described separation occurs, in the case where a solvent contained in the ink enters an interface between the flow passage-forming member and the recording element substrate, adhesiveness between the flow passage-forming member and the recording element substrate is lowered, so that the separation of the flow passage-forming member by stress is more noticeable. Therefore, selectivity of a material capable of being used for the ink was narrowed.

SUMMARY OF THE INVENTION

A principal object of the present invention is to solve the above-described problems of the conventional liquid ejection recording heads.

According to an aspect of the present invention, there is provided a liquid ejection recording head comprising:

a recording element substrate comprising a plurality of energy generating elements for generating energy for ejecting liquid; and a flow passage-forming member, connected to the recording element substrate, comprising a plurality of ejection outlets corresponding to the plurality of energy generating elements and comprising a plurality of flow passages communicating with the ejection outlets, wherein the flow passage-forming member includes a hole array comprising holes arranged so as to surround the flow passages and includes a communication passage, for establishing communication between adjacent holes, at a position close to the recording element substrate.

According to the present invention, it is possible to improve adhesive reliability between the recording element substrate and the flow passage-forming member and thus to retain an image quality.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 6A to 6C are sectional views for illustrating a hole portion array in Second Embodiment of the present invention.

FIG. 7 is a sectional view for illustrating an ink retaining state at communication passages of the hole portion array in Second Embodiment of the present invention.

DESCRIPTION OF THE PREFERRED EMBODIMENTS

Hereinbelow, embodiments of the present invention will be described.

Numerical values described in the following embodiments are illustrative and the present invention is not limited to these numerical values. Further, the present invention is not limited to the respective embodiments described below but may be a combination of these embodiments. The present invention is also applicable to other embodiments to be embraced in the present invention.

The liquid ejection recording head of the present invention is applicable to apparatuses such as a printer, a copying machine, a facsimile machine including a communication system, a device such as a word processor including a printer portion, and the like, in which recording is effected on recording media (materials) such as paper, thread, fiber, fabric, leather, metal, plastic, glass, wood, and ceramics. Further, the liquid ejection recording head may also be used in an industrial recording device compositively combined with various processing devices, and the like. Herein, the term "recording" means not only that a significant image such as a character image or a graphical image is formed on the recording medium, but also that an insignificant image such as a pattern image is formed on the recording medium.

First Embodiment

Figure 4:
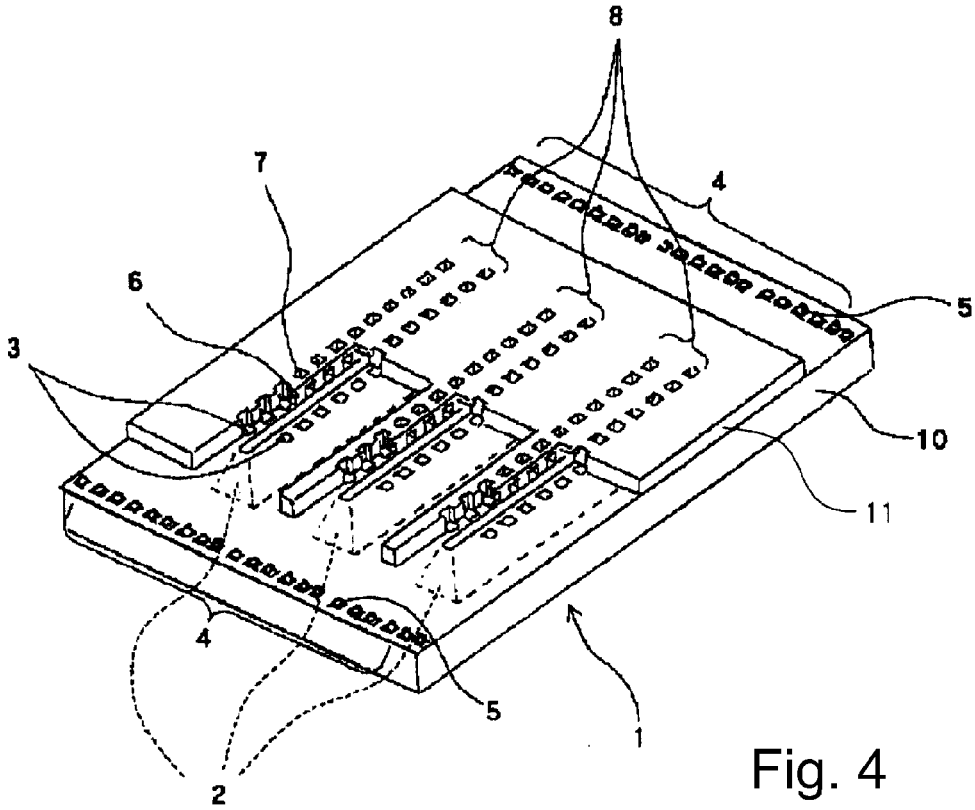
FIG. 4 is a perspective view for illustrating an embodiment of a liquid ejection recording head for suitably carrying out the present invention.

FIG. 4 is a partly broken perspective view showing an embodiment of a liquid ejection recording head by which the present invention is suitably carried out or applied.

A liquid ejection recording head 1 in this embodiment is a recording head of a bubble jet (registered trademark) type using a heat generating resistor for generating thermal energy for causing film boiling with respect to ink depending on an electric signal. Further, the liquid ejection recording head 1 is also a so-called side shooter type recording head in which the heat generating resistor and an ink ejection outlet are disposed oppositely to each other.

The liquid ejection recording head 1 is constituted by laminating an orifice plate 11 as a flow passage-forming member on a recording element substrate 10 such as an Si substrate. The recording element substrate 10 is provided with three ink supply ports 2, for cyan, magenta and yellow, disposed in parallel arrangement. On both sides of each of the ink supply ports 2, heat generating resistors 3 and ink ejection outlets 7 are formed correspondingly to each other so as to form an ejection outlet array 8 for each color. On the Si substrate, electric wiring, a fuse or a resistor or the like, and an electrode portion 4 or the like are formed. Further, on the Si substrate, ink flow passage walls 6 and ink ejection outlets 7 are formed of a resin material by a photolithographic technique. At the electrode portion 4 for supplying electric power to the electric wiring, bumps 5 are formed of Au or the like.

Figure 1:
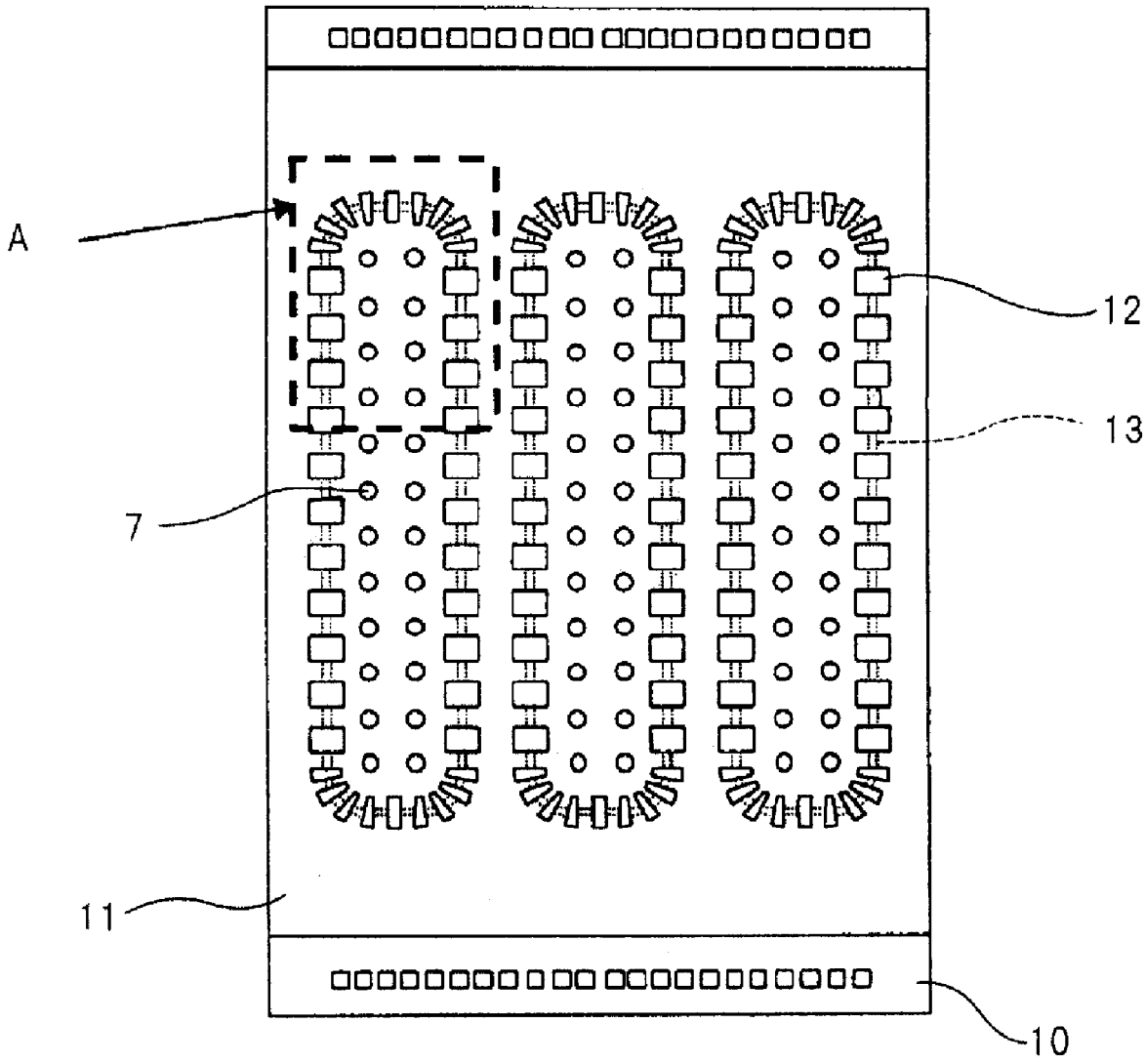
FIG. 1 is a plan view for illustrating First Embodiment of the present invention.

FIG. 1 is a schematic view of the liquid ejection recording head in this embodiment as seen from the orifice plate side.

The liquid ejection recording head 1 was prepared in the following manner. On the recording element substrate 10 on which the heat generating resistors (not shown) for ink ejection were formed, a dissoluble layer of a resin material (polymethyl isopropenyl ketone; "ODUR-1010", mfd. by TOKYO OHKA KOGYO CO., LTD.) was dissolved to form ink supply ports. As a result, a dissolved portion of the resin layer constitutes ink flow passages communicating with the ink ejection outlets 7 and the ink supply ports 2 and the heat generating resistors 3 are present correspondingly to these ink flow passages (FIG. 4). Further, the orifice plate 11 includes hole portion arrays (hole arrays) each constituted by many hole portions (holes) 12 arranged so as to surround an outside of a flow passage corresponding to each ejection outlet array. Between adjacent hole portions 12, a communication passage 13 for establishing communication of the adjacent hole portions 12 with each other is formed at a lower portion of the orifice plate 11 (on a side where the orifice plate 11 contacts the recording element substrate 10).

Figure 2:
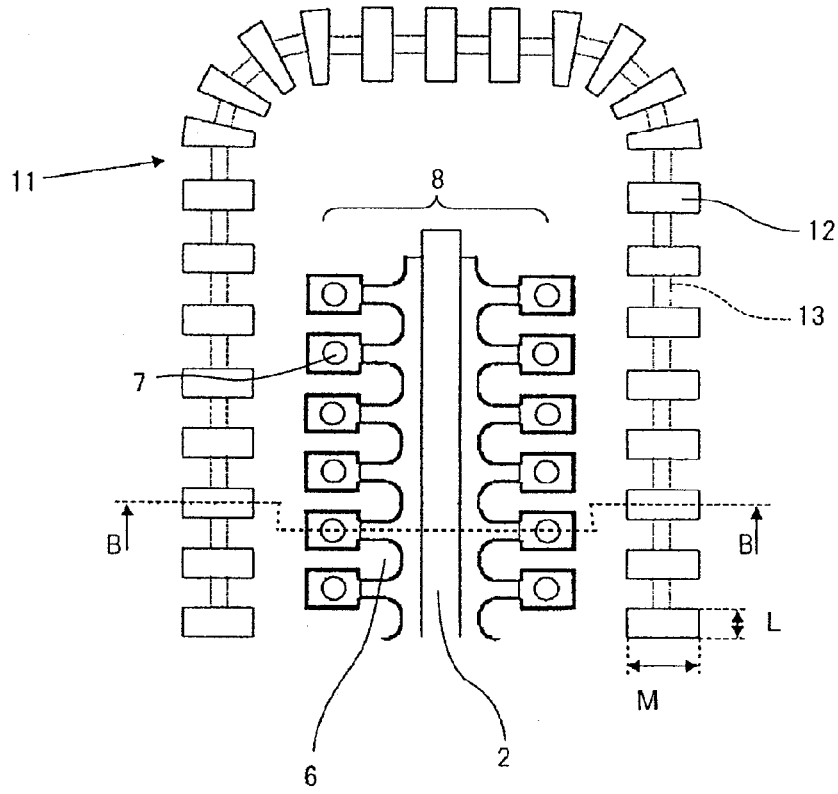
FIG. 2 is an enlarged view of a portion A shown in FIG. 1.

FIG. 2 is a schematic view for illustrating in detail that the orifice plate 11 includes many hole portions 12 formed so as to surround the outside of the flow passages formed in the orifice plate 11 and includes the communication passage 13 for establishing communication of adjacent hole portions 12 with each other at the lower portion of the orifice plate 11, and is also an enlarged view of a portion A shown in FIG. 1. In FIG. 2, the orifice plate 11 is illustrated as a transparent member. In FIG. 2, each hole portion 12 has a width (length) L with respect to an ink ejection outlet array direction of about 0.02 mm and has a width (length) M with respect to a direction perpendicular to the ink ejection outlet array of about 0.45 mm.

Figure 3:
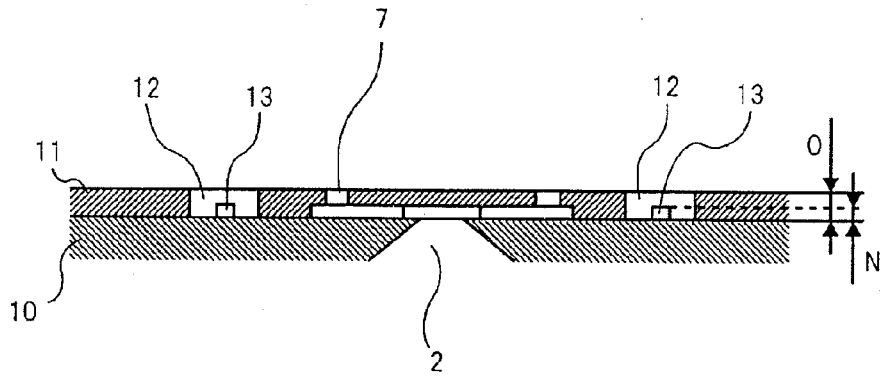
FIG. 3 is a sectional view taken along B-B line indicated in FIG. 2.

FIG. 3 is a sectional view taken along B-B line indicated in FIG. 2. In FIG. 3, the communication passage 13 for establishing the communication at the lower portion of the orifice plate 11 has a height N of about 0.014 mm and many hole portions 12 formed so as to surround the outside of the flow passages formed in the orifice plate 11 have a height O of about 0.025 mm.

Air blow in a drying process during manufacturing of the liquid ejection recording head 1 is performed after ink droplets remaining in many hole portions 12 formed so as to surround the outside of the flow passages formed in the orifice plate 11 are washed. In order to remove water droplets remaining in the hole portions 12 or ink droplets which have not been completely dried, air is blown from a front surface side (corresponding to a downward direction perpendicular to the plane of FIG. 2) toward the orifice plate 11. As in this embodiment, in the case of such a constitution that the communication passage 13 is provided at a portion on the recording element substrate side of the orifice plate 11, a blowing effect of air is sufficiently obtained, so that it is possible to sufficiently remove the water droplets or the ink droplets which have not been completely dried. That is, in the case where the liquid ejection recording head 1 is subjected to a temperature change during transport until the liquid ejection recording head 1 is delivered to a user, it is possible to prevent such a phenomenon that the water droplets remaining in the hole portions 12 or the ink droplets which have not completely dried are vaporized to remain in the hole portions 12 as a viscosity-increased matter or a fixing matter. Therefore, a possibility of an occurrence of a lowering in image quality such as stripes or non-uniformity caused due to such a phenomenon that, during printing by the user, the viscosity-increased matter of the ink or the fixing matter of the ink is drawn out to the head surface and is brought near to the neighborhood of the ink ejection outlets 7 by a wiping operation or the like in a printer is eliminated.

Thus, according to this embodiment, it is possible to solve a problem resulting from residual ink droplets in the drying process during the manufacturing of the liquid ejection recording head.

Second Embodiment

Second Embodiment will be described in detail but constituent parts or members identical to those in First Embodiment are represented by the same reference numerals or symbols.

Figure 5:
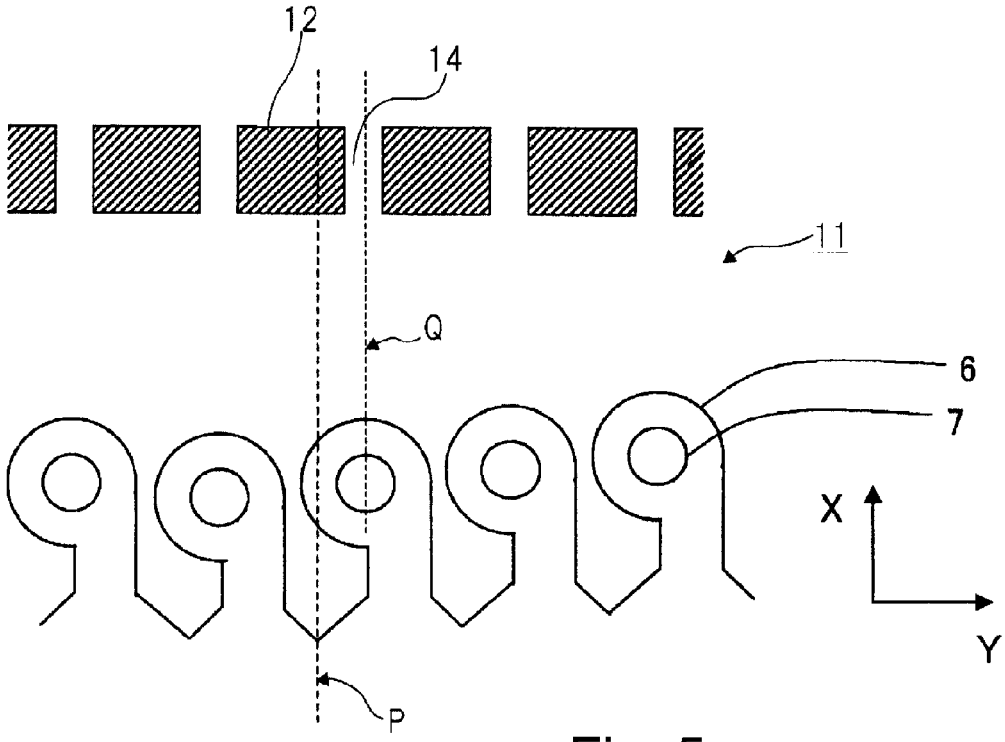
FIG. 5 is a plan view for illustrating Second Embodiment of the present invention.

FIG. 5 is an enlarged plan view of a part of a liquid ejection recording head of this embodiment as seen from above an orifice plate. FIGS. 6A to 6C are schematic views for illustrating a shape of a hole portion array in the orifice plate shown in FIG. 5, wherein FIG. 6B is a sectional view taken along a-a' line indicated in FIG. 6A and FIG. 6C is a sectional view taken along b-b' line indicated in FIG. 6A.

In FIG. 5, ink ejection outlets 7 are disposed to sandwich an ink supply port (not shown) at a density of 300 dpi for each side of the ink supply port and are not arranged in a straight line but are arranged in Y direction while deviating from Y direction toward X direction little by little. Further, similarly as in First Embodiment, at a periphery of a flow passage corresponding to an ejection outlet array, a plurality of hole portions (grooves) 12 is disposed. A distance (OH) from a recording element substrate to a surface of an orifice plate 11 is 70 μm. The flow passage formed on a surface side of the orifice plate 11 for contacting the recording element substrate has a height (a dimension of a flow passage-forming member with respect to its thickness direction) of 20 μm. A distance from a center of each of heat generating resistors (not shown), located correspondingly to the ink ejection outlets 7, to an associated hole portion 12 varies depending on a position thereof but is about 200 μm.

Each of the hole portions 12 has a shape such that a width dimension in X direction is about 63 μm, a width dimension in Y direction is 80 μm, and a depth is the same as OH, i.e., is 70 μm. Further, ink enters the hole portions 12. For this reason, a liquid-resistant film of Ta for protecting electric wiring of the recording element substrate from the ink is formed on the recording element substrate at positions correspondingly to the hole portions 12.

A detailed shape of the hole portions 12 is, as shown in FIG. 5 such that each hole portion 12 located on an extension line P from a position of an end of a nozzle wall which is liable to be separated is formed so as to penetrate through the orifice plate 11. Further, on an extension line Q from a center of each ink ejection outlet 7, a portion which bridges an inside and an outside of each of the hole portions 12, arranged in an array as shown in FIG. 5, in a coplanar manner (hereinafter referred to as a "bridging portion 14") is provided. The bridging portion 14 also functions as a partitioning portion for partition between adjacent hole portions 12. The bridging portion 14 has a width (a dimension in Y direction) of 20 μm and is formed with the same pitch as that of the ink ejection outlets 7, i.e., with a pitch of 300 dpi (about 83 μm). That is, the bridging portion 14 is located at a position corresponding to that of each ink ejection outlet 7 with respect to X direction perpendicular to the array of the ink ejection outlets 7.

Further, as shown in FIG. 6B, under the bridging portion 14, a communication passage (hollow portion) 13 is provided, so that adjacent hole portions 12 communicate with each other. The hollow portion 13 has a height dimension, from a surface at which the orifice plate 11 contacts the recording element substrate 10, of 20 μm which is equal to the height of the flow passage.

Thus, the bridging portion 14 does not hermetically contact the recording element substrate 10, so that an inner area and an outer area of each of the hole portions 12 arranged in the array are placed in a connected state only by rigidity of the bridging portion 14. As a result, the bridging portion 14 constitutes a structure independent of the recording element substrate 10, so that an influence of stress is liable to be separated into an inner portion and an outer portion of each of the hole portions 12 arranged in the array. Therefore, it is possible to suppress the stress concentration at four corners of the substrate and the stress concentration at the nozzle wall end which are caused by the elongated head as described above as the problem of the conventional liquid ejection recording heads.

The shape of this embodiment (a bridging shape shown in FIGS. 5 and 6A to 6C) and shapes of conventional embodiments (a sawtooth-like groove shape as Conventional Embodiment 1 and a groove-less shape as Conventional Embodiment 2) were compared. Results of evaluation of these three shapes with respect to a stress (MPa) applied to the nozzle wall end ("STRESS"), separation at an edge portion of the hole portion array or the grooves ("EDGE SEPARATION"), and separation of the orifice plate at the four corners of the substrate ("CORNER SEPARATION") are shown in Table 1. The ink used is pigment ink.

TABLE 1

| | CONV. EMB. 1 Sawtooth groove | CONV. EMB. 2 Grooveless | SECOND EMB. Bridging shape |
|---|---|---|---|
| STRESS (MPa) | 0.5 | 6.2 | 2.1 |
| EDGE SEPARATION | Occurred | Not occurred | Not occurred |
| CORNER SEPARATION | Not occurred | Occurred | Not occurred |

In this embodiment, as shown in FIG. 6B, the communication passage 13 is provided under the bridging portion 14 and a gap between the bridging portion 14 and the recording element substrate 10 is 20 μm.

In the case where the ink enters this communication passage 13, as shown in FIG. 7, ink 15 is retained in the communication passage 13 due to surface tension and a mist which has entered the hole portions 12 is also liable to enter the communication passage 13 by a meniscus force, so that a mist retention performance is high. As a result, a volume for retaining the ink at the hole portions 12 is increased, so that an effect of preventing (orifice plate) face-wetting ink from reaching the ink ejection outlets 7 is also achieved. Thus, the ink can be retained at the hole portions 12 but, as described in First Embodiment, can be easily moved by applying an external force such as air blow to the ink.

Figure 8:
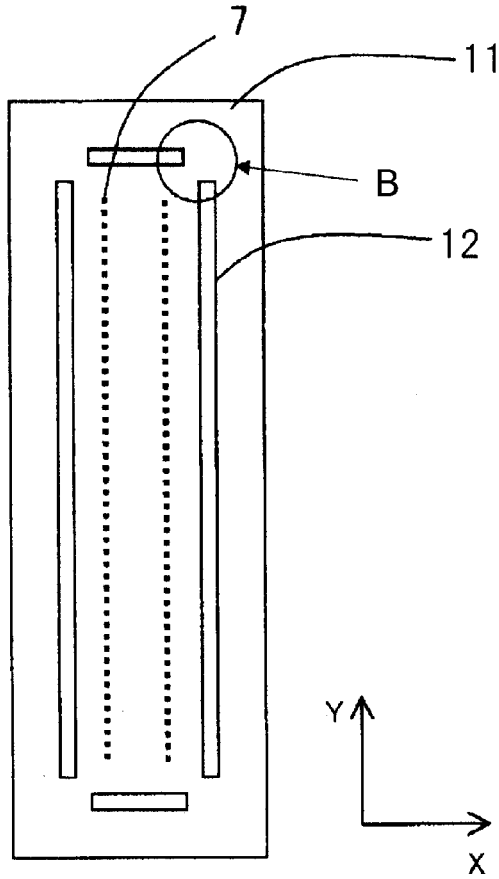
FIG. 8 is a plan view for illustrating a modified embodiment of the hole portion array in Second Embodiment of the present invention.
Figure 9:
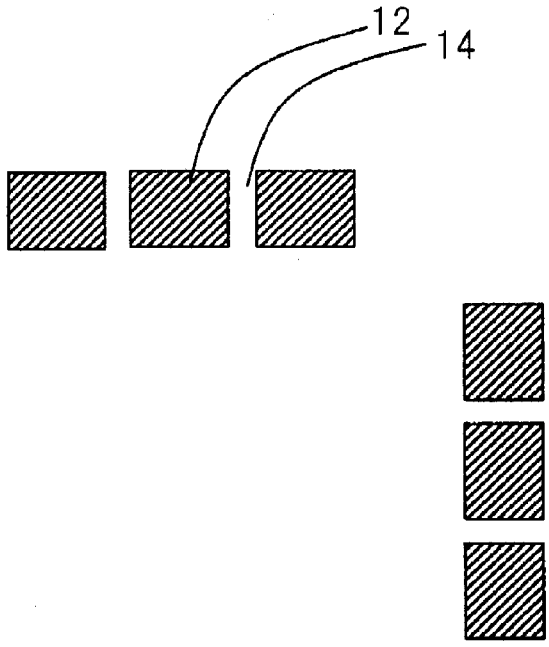
FIG. 9 is an enlarged view of a portion B shown in FIG. 8.
Figure 10:
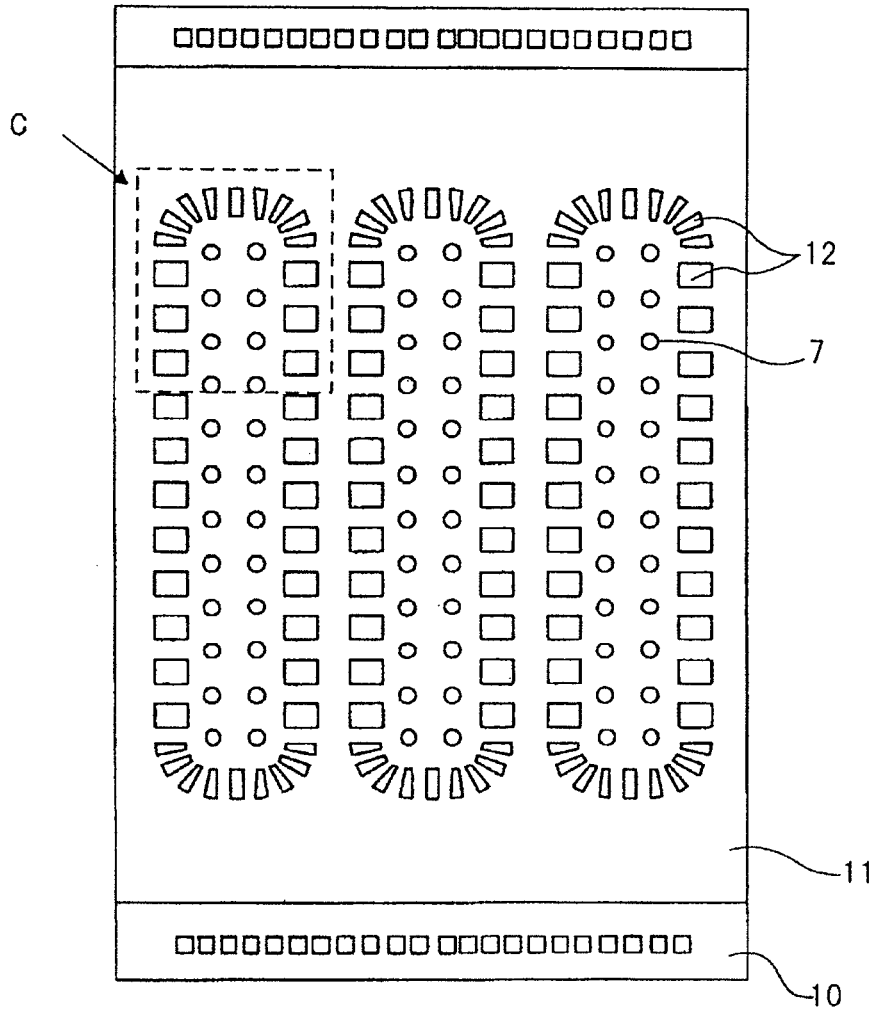
Fig. 10 PRIOR ART
FIG. 10 is a plan view for illustrating a conventional liquid ejection recording head.
Figure 11:
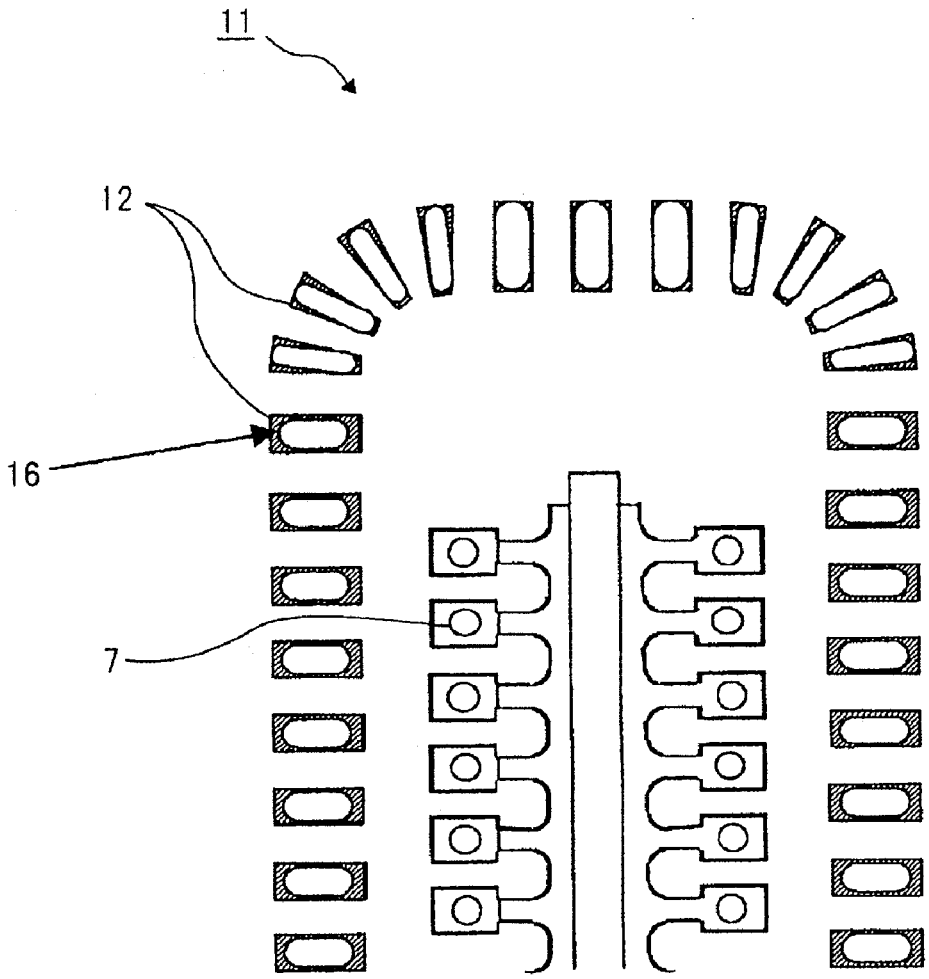
Fig. 11 PRIOR ART
FIG. 11 is an enlarged view of a portion C shown in FIG. 10.

Further, as shown in FIG. 8 and FIG. 9 which is an enlarged view of a portion B shown in FIG. 8, in order to prevent separation of the orifice plate 11 at the four corners of the substrate, the hole portion 12 is not provided at positions corresponding to the four corners of the substrate. Also in this constitution, an effect of eliminating separation at the four corners of the substrate and separation at the nozzle wall end was obtained.

As understood from Table 1, it was found by study of the present inventors that stress was concentrated at the four corners of the substrate to cause separation in a constitution provided with no groove in order to prevent separation of an edge portion of grooves formed at a periphery of ink flow passages. On the other hand, in the groove-formed structure, the separation at the four corners of the substrate did not occur but separation occurred at the edge portion of the grooves, particularly at four corners of the grooves. Further, in the case of the sawtooth groove, the separation at the groove edge portion occurred. Therefore, in this embodiment, in order to prevent the separation at the four corners of the substrate and at the same time in order to prevent the separation at the groove edge portion while forming the grooves at the periphery of the ink flow passages, the grooves were formed in the bridging shape, not the sawtooth shape. That is, by providing the bridging portion to the grooves, the orifice plate material for the outside and inside of the grooves is connected, so that warpage due to the stress is suppressed by strength of the bridging portion to prevent the separation when the groove edge portion is likely to be separated.

In addition, in this embodiment, the hollow structure is provided under the bridging portion in order to further enhance the separation prevention effect at the four corners of the substrate. As a result, the bridging portion does not contact the substrate hermetically, so that the influence of the stress is liable to be separated into the outside and inside of the grooves. Further, the volume for retaining the ink in the grooves is increased, so that the effect of preventing the face-wetting ink from reaching the ink ejection outlets is improved. Particularly, the mist is retained by meniscus at the hollow portion between the bridging portion and the substrate and the mist which has entered the grooves is liable to enter the hollow portion by the meniscus force at the hollow portion, so that the mist retention performance is high.

Third Embodiment

Figure 12:
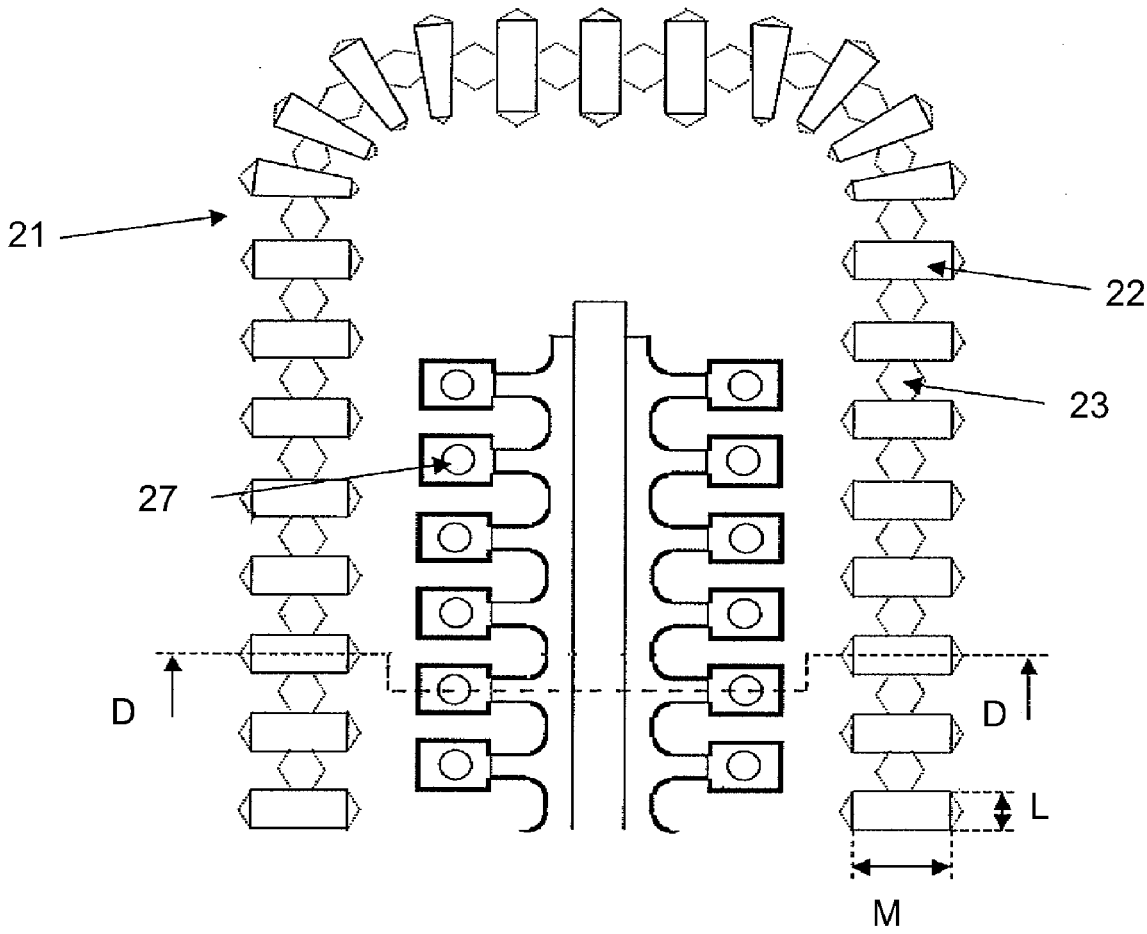
FIG. 12 is a plan view for illustrating Third Embodiment of the present invention.

FIG. 12 is a schematic view for illustrating in detail that the orifice plate 21 includes many hole portions 22 formed so as to surround the outside of the flow passages formed in the orifice plate 21 and includes the communication passage 23 for establishing communication of adjacent hole portions 22 with each other at the lower portion of the orifice plate 21. In FIG. 12, the orifice plate 21 is illustrated as a transparent member. In this embodiment in FIG. 2, each hole portion 22 has a width (length) L with respect to an ink ejection outlet arrangement direction of about 0.02 mm and has a width (length) M with respect to a direction perpendicular to the ink ejection outlet arrangement direction of about 0.45 mm. As shown in FIG. 12, the communication passage 23 for establishing communication at a lower portion of the orifice plate 21 has a sawtooth shape. Similarly, edges of the hole portions 22 have a sawtooth shape. The sawtooth shape has a narrowest portion of 20 μm in width.

Figure 13:
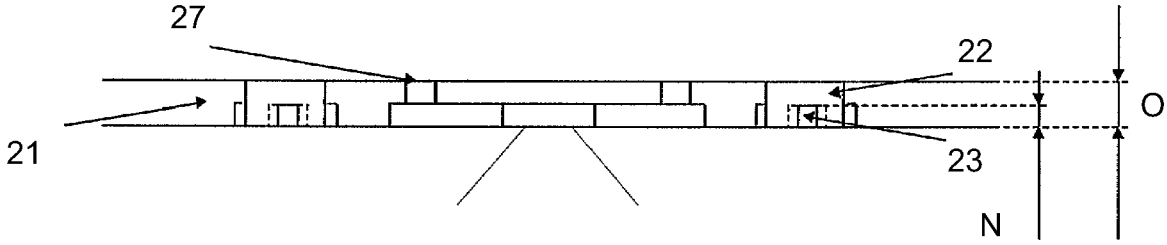
FIG. 13 is a sectional view taken along D-D line indicated in FIG. 12.

FIG. 13 is a sectional view taken along D-D line indicated in FIG. 12. In FIG. 13, the communication passage 23 for establishing the communication at the lower portion of the orifice plate 21 has a height N of 0.014 mm and many hole portions 22 formed so as to surround the outside of the flow passages formed in the orifice plate 21 have a height O of 0.025 mm.

In the constitution of this embodiment, in addition to the effect of First Embodiment, many hole portions 22 formed so as to surround the outside of the flow passages formed in the orifice plate 21, the communication passage 23 for establishing communication of adjacent hole portions 22 with each other at the lower portion of the orifice plate 21, and the like can suitably suppress separation in resistance to an increase in stress caused due to curing of the orifice plate 21 with elongation of the head or due to a temperature change of the orifice plate 21. That is, in the neighborhood of the hole portions 22 or the communication passage 23 of the orifice plate 21, stresses directed in various directions are present in mixture by forming the communication passage 23 and the edge portions of the hole portions 22 in the sawtooth shape, so that the stress acting on the orifice plate 21 within this range is smaller than that in the conventional liquid ejection recording head. Therefore, liability to separation is suppressed at a low level.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 012886/2008 filed Jan. 23, 2008, which is hereby incorporated by reference.

What is claimed is:

1. A liquid ejection recording head comprising:

a recording element substrate comprising a plurality of energy generating elements for generating energy for ejecting liquid; and a flow passage forming-member, connected to said recording element substrate, comprising a plurality of ejection outlets arranged correspondingly to the plurality of energy generating elements and comprising a plurality of flow passages communicating with the ejection outlets, wherein said flow passage-forming member includes a hole array which is provided in parallel to at least one ejection array of the ejection outlets, and wherein the hole array includes:

holes penetrating through said flow passage-forming member, a bridging portion, formed between adjacent holes, for connecting holes of the hole array and an outer peripheral surface of said flow passage-forming member, and a communication passage, for establishing communication between the adjacent holes, at a position located at a side of the bridging portion closer to said recording element substrate.

2. A head according to claim 1, wherein an inner area and an outer area of the hole array are connected in a coplanar manner by the bridging portion between the adjacent holes of said flow passage-forming member.

3. A head according to claim 1, wherein the communication passage is formed between said flow passage-forming member and said recording element substrate at a portion between the adjacent holes.

4. A head according to claim 1, wherein the communication passage and the flow passages have the same dimension with respect to a thickness direction of said flow passage-forming member.

5. A head according to claim 1, wherein the holes and the ejection outlets have the same arrangement pitch.

6. A head according to claim 1, wherein the holes are provided at several positions of said flow passage-forming member excluding positions corresponding to four corners of said recording element substrate.

* * * * *